US006907621B2

(12) United States Patent
Stemen

(10) Patent No.: US 6,907,621 B2
(45) Date of Patent: Jun. 21, 2005

(54) TOILET SEAT LIFTER WITH FLUSHER

(76) Inventor: Robert W. Stemen, 6721 Fern St., Margate, FL (US) 33063-7096

( * ) Notice: Subject to any disclaimer, the term of this patent is extended or adjusted under 35 U.S.C. 154(b) by 70 days.

(21) Appl. No.: 10/411,536

(22) Filed: Apr. 10, 2003

(65) Prior Publication Data

US 2004/0199987 A1 Oct. 14, 2004

(51) Int. Cl.[7] ..... A47K 13/10

(52) U.S. Cl. ..... 4/246.1; 4/246.2; 4/246.3; 4/243.1; 4/249

(58) Field of Search ..... 4/246.1–246.5, 4/243.1, 241, 249, 250

(56) References Cited

U.S. PATENT DOCUMENTS

| | | | | | |
|---|---|---|---|---|---|
| 2,200,687 | A | * | 5/1940 | Bercot | 4/246.1 |
| 2,283,678 | A | * | 5/1942 | Landis | 4/408 |
| 4,007,499 | A | * | 2/1977 | Lin | 4/249 |
| 4,055,864 | A | * | 11/1977 | Liu et al. | 4/253 |
| 4,103,371 | A | | 8/1978 | Wilson | |
| 4,291,422 | A | | 9/1981 | Shoemaker et al. | |
| 4,912,783 | A | | 4/1990 | Shafer | |
| 4,975,988 | A | * | 12/1990 | Won | 4/246.3 |
| 5,014,367 | A | | 5/1991 | Gamblin | |
| 5,029,347 | A | | 7/1991 | Lin | |
| 5,056,165 | A | * | 10/1991 | Wescott, Sr. | 4/246.1 |
| 5,177,818 | A | | 1/1993 | Tsai | |
| 5,222,260 | A | | 6/1993 | Piper | |
| 5,280,653 | A | * | 1/1994 | Tsai | 4/246.2 |
| 5,289,593 | A | | 3/1994 | Lawrence | |
| 5,323,496 | A | * | 6/1994 | Blair | 4/246.3 |
| 5,327,589 | A | | 7/1994 | Rice | |
| 5,339,468 | A | * | 8/1994 | Lin | 4/246.5 |
| 5,349,703 | A | * | 9/1994 | Mocilnikar et al. | 4/250 |
| 5,488,744 | A | | 2/1996 | Paananen | |
| 5,754,985 | A | * | 5/1998 | Dias | 4/246.1 |
| 6,233,751 | B1 | * | 5/2001 | Ford | 4/246.5 |
| 6,351,856 | B1 | | 3/2002 | Browne | |
| 6,434,759 | B1 | * | 8/2002 | Pondelick et al. | 4/246.2 |
| 6,651,262 | B1 | * | 11/2003 | Tinsley | 4/246.1 |

* cited by examiner

*Primary Examiner*—Henry Bennett
*Assistant Examiner*—Amanda Flynn
(74) *Attorney, Agent, or Firm*—Jon A. Gibbons; Fleit, Kain, Gibbons, Gutman, Bongini & Bianco P.L.

(57) ABSTRACT

A mechanism for raising and lowering a toilet seat in response to actuation of foot pedals. An actuation cylinder with a contained piston is connected between the toilet bowl and the toilet seat. Water from the supply line for the toilet is routed to the actuator cylinder when a seat up pedal is depressed and causes the piston to extend out of the actuation cylinder and raise the seat. Operation of a flush pedal causes the water within the actuation cylinder to drain so that the toilet seat lowers. A mechanical linkage from the flush pedal to the flush mechanism of the toilet links toilet flushing to the seat lowering action, ensuring that the seat is lowered after each flush.

9 Claims, 5 Drawing Sheets

100 FIG 1

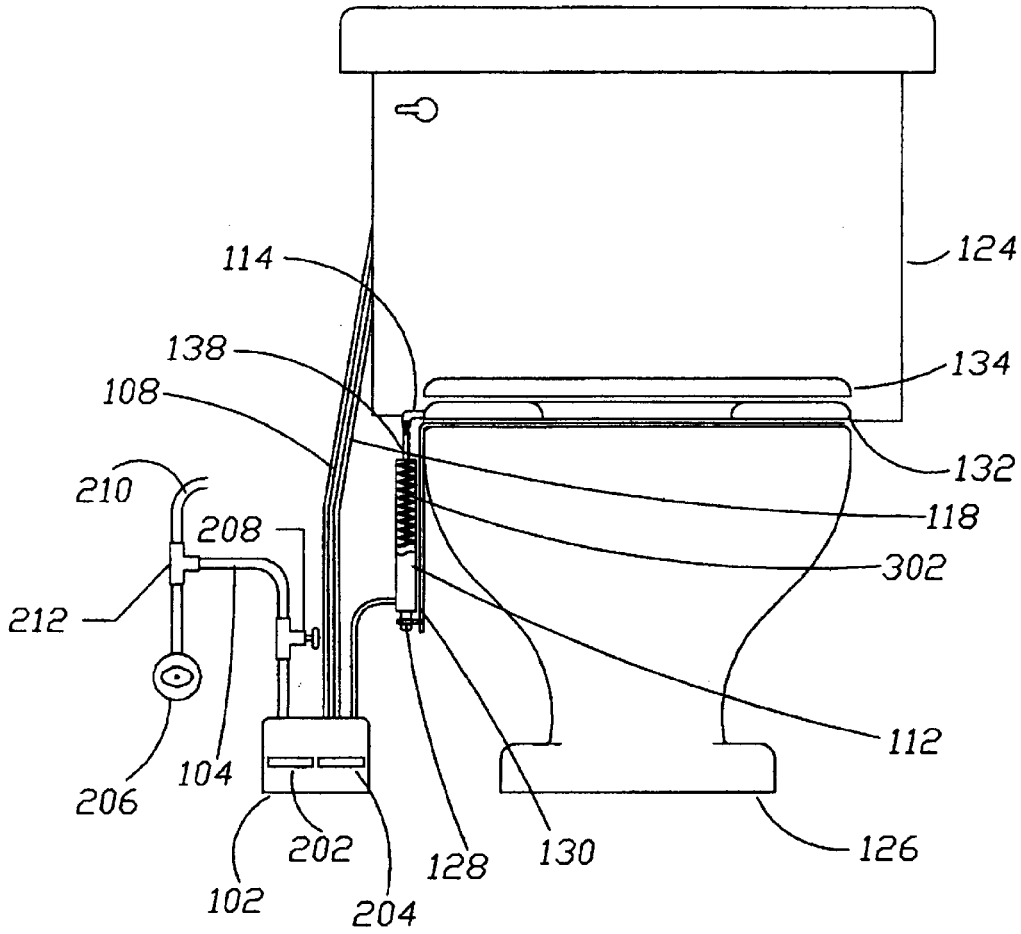
300 FIG 3

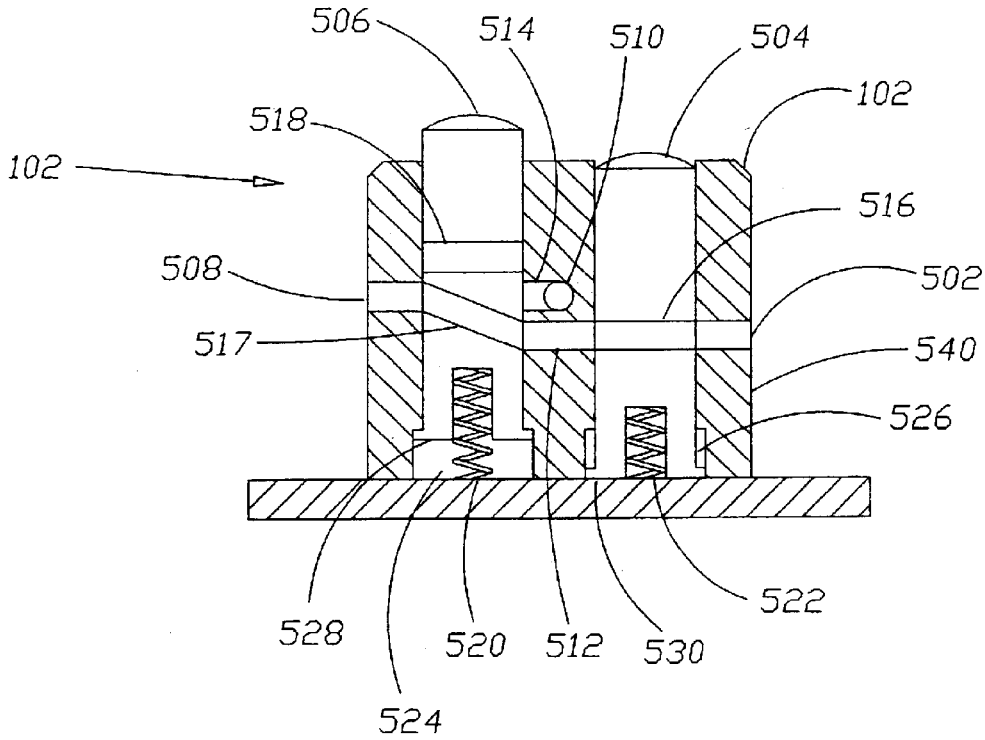
400 FIG 4

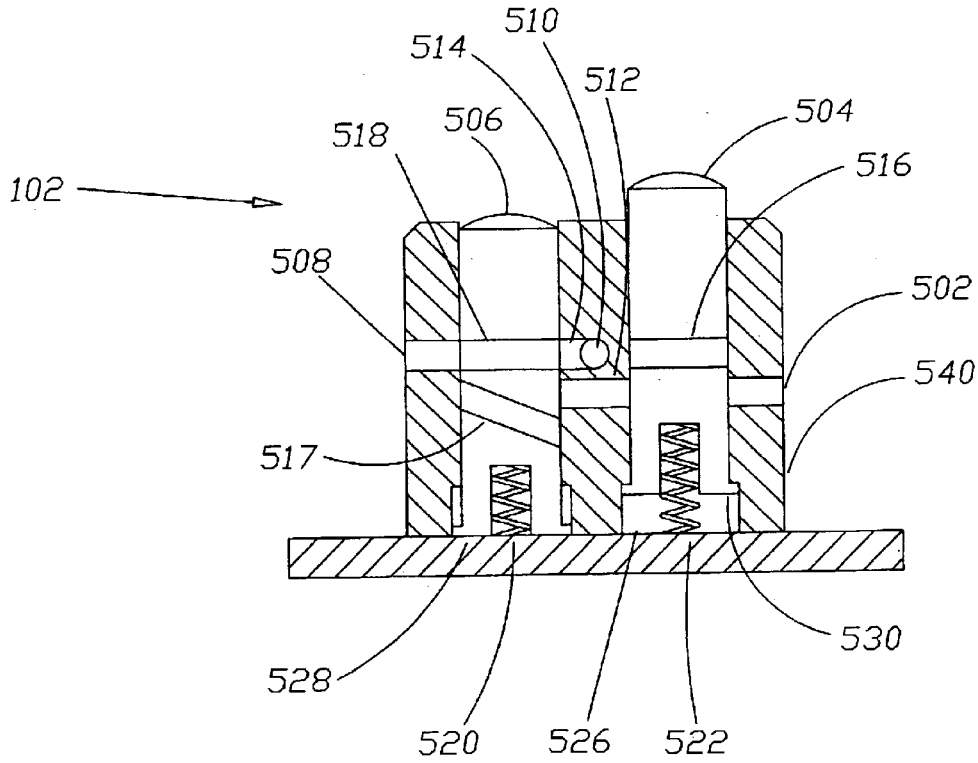
500 FIG 5

TOILET SEAT LIFTER WITH FLUSHER

FIELD OF THE INVENTION

The present invention generally relates to the field of toilet seat lifting mechanisms and more particularly to a toilet seat lifting mechanism that combines toilet flushing and seat lowering.

BACKGROUND OF THE INVENTION

Allowing one to use toilet facilities while avoiding hand contact with the toilet seat or other fixtures associated with the toilet facilities enhancing sanitary conditions. Health problems due to unsanitary practices are well understood. In order to eliminate the need to contact toilet fixtures, several electrical and compressed air solutions have been developed. The use of electrical or compressed air in toilet facilities, particularly commercial toilet facilities, is often impractical or undesirable for a number of reasons. First, the cost for electrical and compressed air equipment is expensive. Second, the complexity of electrical and compressed air systems increase repair and maintenance costs. Third, the placement of electrical power near plumbing fixtures is dangerous and increases the likelihood of electrical shock. Fourth, fixtures or other devices that are used to automatically lift and/or lower toilet seats are required to operate in wet and often dirty conditions which severely limits design options.

The lifting and lowering of the toilet seat is one action where avoidance of using one's hands is particularly desirable. In addition to the desire to raise and lower the toilet seat without using one's hands, there is also a desire to ensure that the toilet seat is returned to its lowered position after the toilet is used. The contention between men and women of "who left the seat up?" is often a source of disagreement. The problem with returning the toilet seat to its lowered position after toilet use is that manually doing so is easily forgotten and typically avoided to eliminate contact with toilet fixtures.

Therefore, a need exists to overcome the problems with the prior art as discussed above.

SUMMARY OF THE INVENTION

According to a preferred embodiment of the present invention, a toilet seat raising mechanism, that is for operation with a toilet having a seat, has an input line and a first control that causes a first change in a pressure in the input line from a first pressure level to a second pressure level in response to a first activation input. The toilet seat raising mechanism further has a seat actuator adapted for moving a toilet seat between a lowered position and a raised position in response to changes in the pressure in the input line. The seat actuator places the toilet seat in the lowered position when the pressure is at the first pressure level and the seat actuator places the toilet seat in the raised position when the pressure is at the second pressure level. The toilet seat raising mechanism also has a second control that operates in response to a second input to selectively place the input line in communication with a drain so as to cause a second change in the pressure from the second pressure level towards the first pressure level. The toilet seat raising mechanism also has a flush actuator for flushing a toilet in response to an operation of the second control.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

FIG. 3 is a front view of another embodiment of the toilet with a toilet seat lifting mechanism with a return spring according to an embodiment of the present invention.

FIG. 4 is a cut-away view of a foot actuator valve for a toilet seat lifter that is configured to lift a toilet seat according to an embodiment of the present invention.

FIG. 5 is a cut-away view of a foot actuator valve for a toilet seat lifter that is configured to flush the toilet and lower the toilet seat according to an embodiment of the present invention.

DETAILED DESCRIPTION

It is important to note, that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and visa versa with no loss of generality.

The present invention, according to an exemplary embodiment, overcomes problems with the prior art by providing a toilet seat lifting mechanism that includes foot operated valves that control the flow of water to a hydraulic cylinder that operates to lift and lower a toilet seat. Water from the water supply to the toilet is connected, in response to a user's operation of a valve, to the hydraulic cylinder to provide energy to lift the toilet seat. The user subsequently operates another valve that causes the water in the cylinder to drain, thereby causing the toilet seat to lower. The drained water in the exemplary embodiment is returned to the toilet tank for use in flushing the toilet. By returning the water back in the toilet tank the present invention does not increase water usage. This is important in applications where water conservation and low-flow toilets are required. The toilet flushing mechanism is connected to the mechanism that activates the valve that causes the cylinder to drain, so that a user's flushing of the toilet also causes the toilet seat to lower, advantageously ensuring that the toilet seat remains in a lowered position after each use. Further, the present invention works with both tank and tank-less type existing toilets without the need to modify the toilet mechanism.

Figure 1:
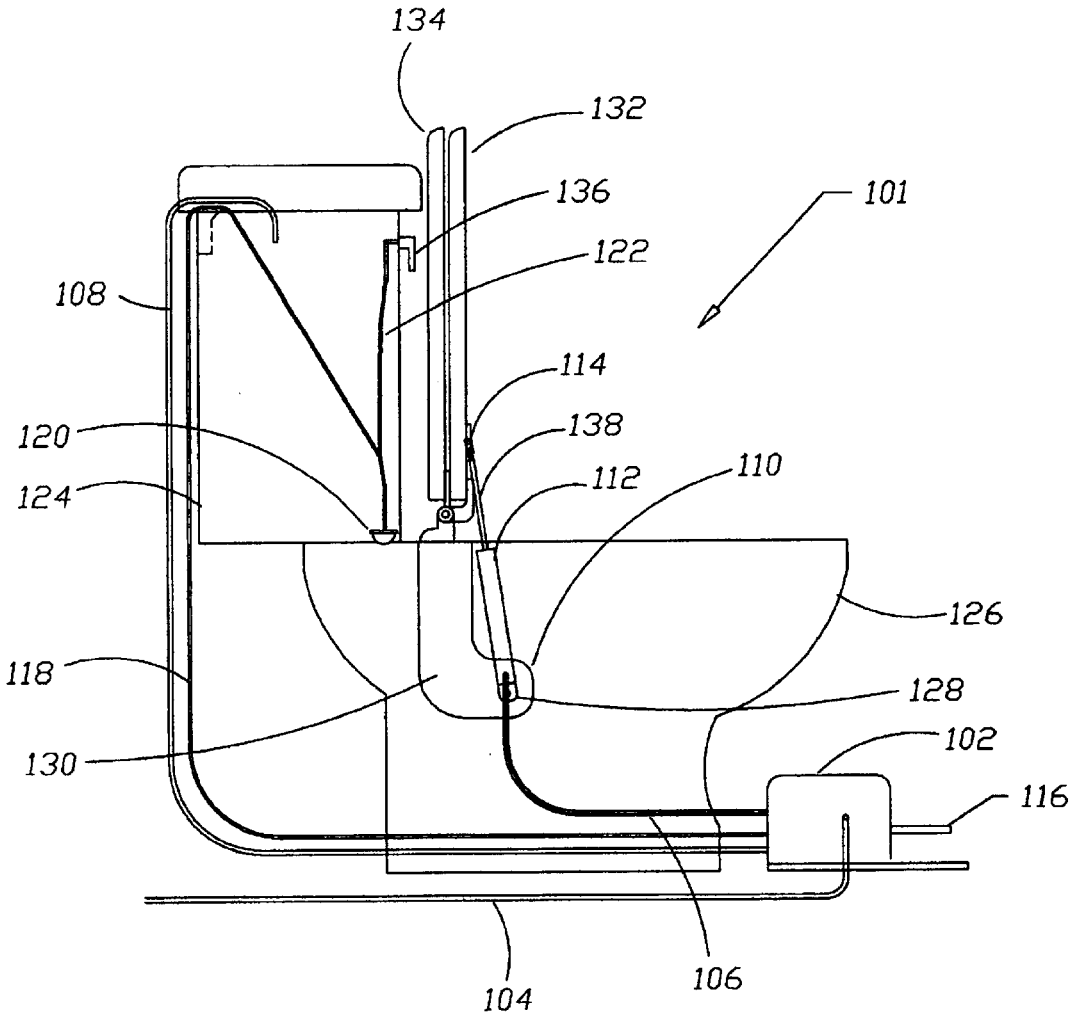
FIG. 1 is side view of a toilet that has a toilet seat lifting mechanism according to an embodiment the present invention.

A side view 100 of a toilet 101 that includes a toilet seat lifting mechanism in accordance with an exemplary embodiment of the present invention is illustrated in FIG. 1. The toilet 101 includes a conventional toilet tank 124 and toilet bowl 126. Attached to the toilet bowl 126 is a toilet seat 132 and toilet lid 134. The toilet 101 includes a conventional flush actuator that includes a flapper valve 120, flapper valve chain 122 and flush handle 136.

The toilet 101 further includes a toilet seat raising mechanism that is a toilet seat lifter. The toilet seat lifter includes a seat actuator that includes a lifter mounting bracket 130, a cylinder 112 that operates a piston 138 and a seat clevis mount 114. Cylinder 112 is attached to the lifter-mounting bracket 130 by a cylinder clevis mount 128. The toilet seat lifter further has a control mechanism that includes a foot actuated control valve 102 that includes pedals 116, a lifter water supply line 104, a cylinder water supply line 106 and a flush cable 118. The flush cable 118 is a mechanical linkage between a flush pedal, described below, and the flush actuator so that operation of the flush pedal causes actuation of the flush actuator. When the toilet seat 132 is lowered, the water contained in the cylinder 112 is routed through a water release line 108 into the toilet tank 124 by the foot actuated control valve 102.

Figure 2:
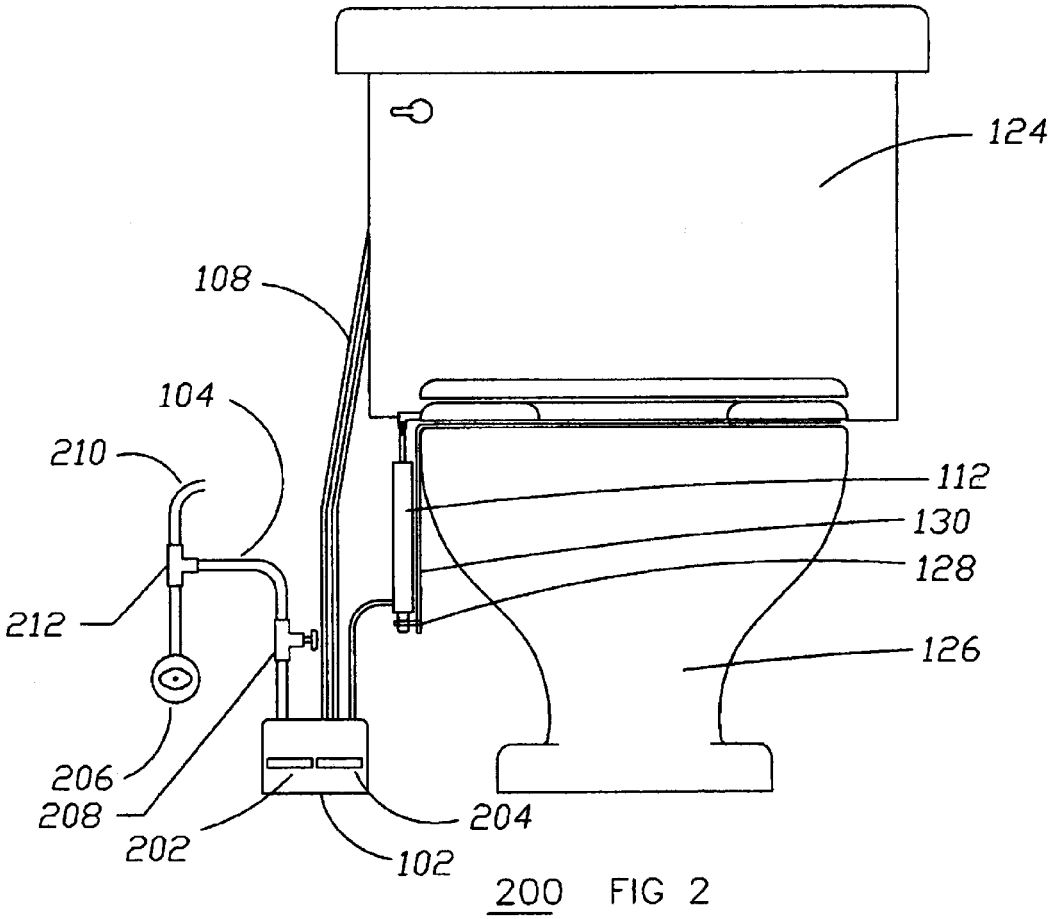
FIG. 2 is a front view of a toilet with a toilet seat lifting mechanism of FIG. 1 according to an embodiment of the present invention.

A front water supply view 200 of the toilet 101 of FIG. 1, that incorporates an embodiment of the present invention is illustrated in FIG. 2. The toilet 101 has a toilet water supply line 210 that delivers supply water to the toilet tank 124 as well as to the toilet seat lifter. The toilet 101 of the exemplary embodiment incorporates a conventional float valve (not shown) that is internal to the toilet tank 124 and allows water to enter the toilet tank 124 until a predetermined water level is reached inside of the toilet tank 124. Alternative embodiments of the present invention are suited for use with tank-less toilets that have a conventional flush valve. Shutoff valve 206 turns the supply of water into the toilet water supply line 210 on and off, primarily for maintenance purposes. The water supply line 210 of the exemplary embodiment has a line Tee 212 that connects the water supply line to both the toilet tank and to a lifter water supply line 104. The water supply line 104 supplies water, through an in-line shut off valve 208 to the foot activator valve 102, that is described in detail below. The water supply line is at a typical household water pressure. Moreover, although the term water supply line is used throughout the present invention, other liquids such as those used in temporary facilities such as "Port a Johns" which are within the true scope and spirit of the present invention. The foot activator valve 102 of the exemplary embodiment 102 controls the flow of water to and from the cylinder 112 to cause the toilet seat 132 and toilet seat lid 134 to lift and lower. The foot activator valve 102 has a seat-up pedal 204 that is a first control that accepts a first actuation input that is given by a user pressing the seat-up pedal 204 with his or her foot. The foot activator valve 102 further has a flush pedal 202 that is a second control that accepts a second input that is given when a user presses the flush pedal 202 with his or her foot. Operation of the seat-up pedal 204 or the flush pedal 202 operates valves within the foot actuator valve 102 to cause water pressure in the cylinder water supply line 116 to change between a first pressure level and a second pressure level. The cylinder 112 of the exemplary embodiment is configured to cause the toilet seat 132 to be in a raised position when the water pressure supplied to the cylinder through the input line, i.e., the valve cylinder water supply line 106, is at a high level and to cause the toilet seat 132 to be in a lowered position when the water pressure in the input line is at a lower level.

Alternative embodiments of the present invention utilize automatic flush actuators that are based upon infrared or other detection means to automatically initiation flushing of the toilet. An example of these automatic flush actuators is the Optima Flushometer line that is manufactured by the Sloan Valve Company of Franklin Park, Ill., USA. These embodiments use the automatically triggered flush actuation of these automatic flush actuators to provide activation of seat actuator control valves similar to the activation of the valves described by the pressing of the flush pedal 202 as is described herein.

A cylinder connection front view 300 of an alternative embodiment of the present invention is illustrated in FIG. 3. In addition to the components illustrated in the front water supply view 200, the cylinder 112 is shown to be connected to the toilet bowl 126 by cylinder bracket 130. The top end of cylinder bracket 130 of the exemplary embodiment is secured to the toilet bowl 126 by the bolts that secure the toilet seat 132 and toilet lid 134 to the bowl 126. The opposite end of the cylinder bracket in the exemplary embodiment connects to the cylinder 112 by the cylinder clevis mount 128. The cylinder plunger 138, which is on the opposite end of cylinder 112, is connected to the toilet seat 132 via a seat clevis mount 114. Seat clevis mount 114 and the cylinder clevis mount 128 allow rotation of the joint formed by the clevis mounts with the cylinder 112 and cylinder plunger 134 as needed due to the lifting of the toilet seat 132. This alternative embodiment of the present invention has an external yieldable member, in the form of spring 302 within cylinder 112 that exerts a downward force on the cylinder plunger 138 and urges the toilet seat 132 into a lowered position in the absence of force from cylinder 112. Other embodiments alternatively include a similar spring that internal to cylinder 112 and that urges the toilet seat 132 into a lowered position.

A cut away view of a seat up position 400 of the foot actuated valve 102 of an embodiment of the present invention is illustrated in FIG. 4. The foot actuated valve 102 of the exemplary embodiment has a valve housing 540 in which are moveably mounted a flush piston 506 and a seat actuator piston 504. The flush piston 506 and the seat actuator piston 504 have channels that are selectively placed into a flow channel that carries a liquid, such as water in the exemplary embodiment. The flush piston 506 has a flush piston base 528 to ensure proper positioning of the flush piston 506 in the absence of a flush pedal pressing input. The flush piston 506 is mounted in and is able to move in a flush piston cavity 524. A flush piston spring 520 urges the flush piston 506 into an upper position. The seat actuator piston 504 has a seat actuator piston base 530. The seat actuator piston 504 is mounted in and is able to move in a seat actuator piston cavity 526. A seat actuator piston spring 522 urges the seat actuator piston 504 into an upper position. The flush piston 506 is depressed into a lower position by pressing down of the flush petal 202. The seat actuator piston 504 is depressed into a lower position by pressing down of the seat up petal 204.

The cut away view of a seat up position 400 shows the seat actuator piston 504 to be in a lower position, which indicates that the first control, i.e., the seat up pedal 204, has received a first activation input by being pressed by the user's foot. The flush piston 506 is shown to be in an upper position, as is urged by the flush piston spring 520 without the pressing of the flush petal 202. Supply water enters the water supply input 502 and flows through seat actuator cylinder channel 516 to the middle channel 512. Seat actuator cylinder channel 516 is in a proper location so as to place the water supply input 502 in communication with the middle channel 512 by being urged into its lower position though pressing of the seat up pedal 204. The flush piston 504 is shown in an upper position thereby placing the middle channel 512 into communication with a valve cylinder outlet 508 through an inlet to cylinder channel 517 within the flush cylinder 506. The valve cylinder outlet 508 of the exemplary embodiment is an input line in which water pressure is changed to cause the seat actuator to raise and lower the toilet seat. Prior to activation of the seat up pedal 204, the pressure in the valve cylinder outlet 508 is at a low pressure, as is described below. The configuration of the seat actuator piston being in the down position causes the valve cylinder outlet 508, i.e., the input line, to change from a first pressure level, which is the initial low pressure, to a second pressure level, which is the pressure of the water supply entering at the water supply inlet 502. The water provided at the valve cylinder outlet 508 is communicated to the cylinder 112 through the cylinder water supply line 116. Providing the water to the cylinder 112 at the water supply pressure level causes the cylinder 112 to raise the toilet seat 132 to a raised position.

A cut away view of a flush position 500 of the foot activator valve 102 according to an exemplary embodiment of the present invention is illustrated in FIG. 5. The cut away view of a flush position 500 shows the flush cylinder 506 to be in a lower position, which is cause by a second input, i.e., the pressing down the flush pedal 202. The seat actuator piston 504 is shown in an upper position, as is urged by the seat actuator spring 202 without depressing the seat up pedal 204. The seat actuator cylinder channel 516 is no longer in a position to allow water to flow from the water supply inlet 502 to the middle channel 512 when the seat actuator piston 504 is in the upper position. The middle channel is also no longer in communication with the valve cylinder outlet 508 while the flush piston 506 is in the lower position because the inlet to cylinder channel 517 is moved. With the flush piston in a lower position, the cylinder drain channel 518 in the flush piston 506 is in position to allow water in the cylinder 112 to be routed into the water release port 510. This places the valve cylinder outlet 508 in communication with a drain and causes a second change in the pressure within the valve cylinder outlet 508 from the second pressure level towards the first pressure level. Causing the pressure within the valve cylinder outlet 508 to return to a lower pressure level allows the cylinder piston 108 to return to its position within the cylinder 112 and allows the toilet seat 132 to return to its lowered position. The mechanical linkage 118 between the flush pedal 202 and the flush mechanism ensures that the seat is lowered after each flush of the toilet. This is enhanced in some embodiments by removing other flush actuation mechanisms, such as the flush handle of a conventional toilet.

The exemplary embodiments of the present invention advantageously provide a foot activated toilet seat raising and lowering device that is linked to the toilet flush mechanism. These embodiments allow a user to raise the toilet seat without touching the seat by hand. These embodiments also couple the toilet seat lowering function to the flush activation, so that the toilet seat is lowered after each flush, ensuring that the toilet seat is in a lowered position for the next user.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A toilet seat raising mechanism comprising;

an input line for connection with a water supply line under pressure;

a seat actuator adapted for moving a toilet seat between a lowered position and a raised position in response to changes in the pressure, wherein the seat actuator places the toilet seat in the lowered position when the pressure is at a first pressure level and the seat actuator places the toilet seat in the raised position when the pressure is at a second pressure level;

a first control for causing a first change in the pressure in the seat actuator from a first pressure level to a second pressure level in response to a first activation input;

a second control operating in response to a second input to selectively place the input line in communication with a drain and thereby causing a second change in the pressure from the second pressure level towards the first pressure level; and a flush actuator for flushing a toilet in response to an operation of the second control.

2. The toilet seat raising mechanism according to claim 1, wherein the flush actuator comprises a mechanical linkage to the second control and operates in response to the second input.

3. The toilet seat raising mechanism according to claim 1, further comprising a yieldable member for urging the toilet seat into the lowered position.

4. The toilet seat raising mechanism according to claim 1, wherein a foot operated pedal provides the first input.

5. The toilet seat raising mechanism according to claim 1, wherein a foot operated pedal provides the second input.

6. The toilet seat raising mechanism according to claim 1, wherein the drain is in communication with a toilet water tank of the toilet.

7. The toilet seat raising mechanism according to claim 1, further comprising a valve housing comprising a water supply input, a valve cylinder outlet, a water release port, wherein the water supply input is connected to a water supply under pressure, and wherein:

the first control selectively places the water supply input in communication with the valve cylinder outlet in response to the first input; and the second control:

selectively prevents communication between the water supply input and the valve cylinder outlet; and selectively places the valve cylinder outlet in communications with the water release port.

8. The toilet seat raising mechanism according to claim 7, wherein the first control is contained within the valve housing and the first control comprises:

a seat actuator piston cavity, contained within the valve housing;

a seat actuator piston, moveably mounted within the seat actuator piston cavity;

a seat actuator cylinder channel that is located within the seat actuator piston and positioned so as to selectively place the water supply input in communication with the valve cylinder outlet based upon the position of the seat actuator piston within the seat actuator piston cavity; and a seat actuator piston spring for urging the seat actuator piston into a position that prevents communication between the water supply input and the valve cylinder outlet.

9. The toilet seat raising mechanism according to claim 7, wherein the second control is contained within the valve housing and the second control comprises:

a flush piston cavity, contained within the valve housing;

a flush piston, moveably mounted within the flush piston cavity; an inlet to cylinder channel that is located within the flush piston and positioned so as to selectively place the water supply input in communication with the valve cylinder outlet based upon a first position of the flush piston within the flush piston cavity;

a cylinder drain channel that is located within the flush piston and positioned so as to, based upon a second position of the flush piston within the flush piston cavity, selectively place the valve cylinder outlet in communication with the water release port when the inlet to cylinder channel is not in a position to allow communication between the water supply input and the valve cylinder outlet; and a flush piston spring for urging the flush piston into a position that prevents communication between the valve cylinder outlet and the water release port.

* * * * *